US011204144B2

(12) United States Patent
Xu et al.

(10) Patent No.: US 11,204,144 B2
(45) Date of Patent: Dec. 21, 2021

(54) LED FLAME BULB AND LIGHT STRING CONTAINING SAME

(71) Applicant: JIANGMEN LIDU LIGHTING CO., LTD., Jiangmen (CN)

(72) Inventors: Guodu Xu, Jiangmen (CN); Shaoming Lu, Jiangmen (CN)

(73) Assignee: JIANGMEN LIDU LIGHTING CO., LTD., Jiangmen (CN)

( * ) Notice: Subject to any disclaimer, the term of this patent is extended or adjusted under 35 U.S.C. 154(b) by 0 days.

(21) Appl. No.: 15/733,534

(22) PCT Filed: Aug. 7, 2019

(86) PCT No.: PCT/CN2019/099543

§ 371 (c)(1),
(2) Date: Aug. 21, 2020

(87) PCT Pub. No.: WO2021/007892

PCT Pub. Date: Jan. 21, 2021

(65) Prior Publication Data

US 2021/0254803 A1 Aug. 19, 2021

(30) Foreign Application Priority Data

Jul. 17, 2019 (CN) ..... 201910646338.7

(51) Int. Cl.
*F21S 10/04* (2006.01)
*F21S 4/20* (2016.01)
(Continued)

(52) U.S. Cl.
CPC ..... *F21S 10/043* (2013.01); *F21S 4/20* (2016.01); *F21V 23/003* (2013.01); *H05B 45/30* (2020.01);
(Continued)

(58) Field of Classification Search
CPC .. F21K 9/23; F21K 9/232; F21K 9/238; F21S 10/04; F21S 10/043; F21S 10/046;
(Continued)

(56) References Cited

U.S. PATENT DOCUMENTS 10,028,353 B2 7/2018 Chen
10,344,930 B1 7/2019 Mitchell, Jr.
(Continued)

FOREIGN PATENT DOCUMENTS

CA 2577486 A1 8/2008
CN 103561507 A 2/2014
(Continued)

OTHER PUBLICATIONS

International Search Report dated Apr. 20, 2020 from PCT Application No. PCT/CN2019/099543.

*Primary Examiner* — Renan Luque
(74) *Attorney, Agent, or Firm* — Innovation Capital Law Group, LLP; Vic Lin

(57) ABSTRACT

Provided are an LED flame bulb and a light string, the LED flame bulb including an LED light strip and a light strip control component, the light strip comprises a substrate and a plurality of LED beads. The substrate is divided into a flame bottom area, a flame core area and an outer flame area in order from one end to the other end, and the plurality of LED beads are arranged in the flame bottom area, the flame core area and the outer flame area; at least 2 LED beads are arranged in the flame core area; the light strip control component controls the LED beads in the flame bottom area and the outer flame area to be on and off at a set frequency, and controls the LED beads in the flame core area to be on and off in sequence.

5 Claims, 6 Drawing Sheets

(51) Int. Cl.
*H05B 47/155* (2020.01)
*H05B 45/30* (2020.01)
*F21V 23/00* (2015.01)
*F21Y 115/10* (2016.01)

(52) U.S. Cl.
CPC ..... *H05B 47/155* (2020.01); *F21Y 2115/10* (2016.08)

(58) Field of Classification Search
CPC ..... F21S 6/001; F21S 9/02; F21V 23/003; F21V 23/04; F21V 3/02; F21W 2121/00; F21Y 2101/00; F21Y 2105/10; F21Y 2113/13; F21Y 2115/10; H05B 39/09; H05B 45/10; H05B 45/20; H05B 45/30; H05B 45/397; H05B 47/155; Y02B 20/30; Y10S 362/80; Y10S 362/806; Y10S 362/81
See application file for complete search history.

(56) References Cited

U.S. PATENT DOCUMENTS 10,422,495 B1 9/2019 Mitchell, Jr.
2005/0196716 A1* 9/2005 Haab ..... F21S 10/043 431/126
2006/0208666 A1* 9/2006 Johnson ..... H05B 45/10 315/294
2012/0049765 A1* 3/2012 Lu ..... H05B 45/20 315/312
2015/0369432 A1* 12/2015 Li ..... F21K 9/23 362/249.02
2018/0163937 A1* 6/2018 Lee ..... F21S 10/043
2019/0360651 A1 11/2019 Mitchell, Jr.

FOREIGN PATENT DOCUMENTS

CN 204157098 U 2/2015
CN 206130878 U 4/2017
CN 106764915 A 5/2017
CN 108076565 A 5/2018
CN 207740994 U 8/2018
CN 208475210 U 2/2019
CN 109519860 A 3/2019
CN 109882794 A 6/2019
CN 209386191 U 9/2019
CN 209540754 U 10/2019

* cited by examiner

LED FLAME BULB AND LIGHT STRING CONTAINING SAME

CROSS REFERENCE TO RELATED APPLICATIONS

This application is a national application of International Application PCT/CN2019/099543, with an international filling date of Aug. 7, 2019. The contents of PCT/CN2019/099543 are all hereby incorporated by reference.

FIELD OF TECHNOLOGY

The following relates to the field of light, in particular to an LED flame bulb which simulates flame flicker, and a light string including the LED flame bulbs.

BACKGROUND

In modern life, electric lighting has replaced traditional ignition lighting. Therefore, people now light candles, oil lamps, etc. in most cases not for lighting, but to create a warm, inviting atmosphere, or out of the need to follow traditional rituals. For example, in China, people light incense candles on Chinese New Year's Day, or have candlelight dinners in Western restaurants.

Meanwhile, burning flames in many instances may result in fire accidents which, if unattended or not properly controlled, can produce extensive damage, smoke or pollution. Especially in closed, crowded places, even a risk of suffocation. In addition, unattended candles or flames may burn young children playing around, and candles or oil lamps have the disadvantage of not being reusable.

SUMMARY

An aspect relates to LED flame bulbs and light strings installed with any one of the above LED flame bulbs.

In some embodiments, an LED flame bulb includes an LED light strip and a light strip control unit, wherein the light strip includes a substrate and a plurality of LED beads. The substrate is divided into a flame bottom area, a flame core area and an outer flame area in order from one end to the other end, and the plurality of LED beads are respectively arranged in the flame bottom area, the flame core area and the outer flame area; there are at least 2 LED beads in the flame core area; the light strip control unit controls the LED beads in the flame bottom area and the outer flame area to be on and off at a set frequency respectively, and controls the LED beads in the flame core area to be on and off in sequence.

In some embodiments, the brightness of the LED beads in the flame core area is higher than that of the LED beads in the flame bottom area and the outer flame area.

In some embodiments, the rated power of the LED beads in the flame core area is greater than that of the LED beads in the flame bottom area and the outer flame area; or the current provided by the light strip control unit to the LED beads in the flame core area is greater than the current provided by it to the LED beads in the flame bottom area and the outer flame area.

In some embodiments, the ratio of the luminous power of the LED beads in the flame bottom area, the flame core area and the outer flame area is 1:(3~5):(2~3).

In some embodiments, the light strip control unit controls the current supplied to the LED beads in the flame bottom area, the flame core area and the outer flame area to vary with time, which further adjusts the brightness of the LED beads in each area with time to simulate the vivid flame brightness change.

In some embodiments, the every two LED beads are connected inversely in parallel and then connected in series to the light strip control unit.

In some embodiments, a LED flame bulb string, including a plurality of LED flame bulbs; the LED flame bulb string further includes a light string control unit and a connecting portion, which includes a positive wire and a negative wire; the plurality of LED flame bulbs are connected in parallel, of which the positive poles are connected to the light string control unit through the positive wire, and the negative poles are connected to the light string control unit through the negative wire.

In some embodiments, the light string control unit includes a signal generator and a driving signal conversion unit; the driving signal conversion unit includes a diode, a PMOS transistor, a first resistor and a second resistor; The positive pole of the diode is connected to a DC power, and the negative pole of the diode is connected to the drain pole of the PMOS transistor through a first branch, and the negative pole of the diode is also connected to the positive wire of the connection portion through a second branch. The gate of the PMOS transistor is connected to the output end of the signal generator through a first resistor, and is connected to a DC power through a second resistor, and the source pole of the PMOS transistor is also connected to the DC power source; the signal generator outputs a driving signal to the positive wire of the connecting portion through the PMOS transistor of the driving signal conversion unit, and then controls the LED bulbs on the light string to light up in constant lighting mode simultaneously or sequentially, or light up in flame flicker emulation mode simultaneously or sequentially.

In some embodiments, the light string control unit also includes an infrared signal receiving unit and/or a key signal input unit; the infrared signal receiving unit includes an infrared signal receiving unit, and the infrared signal receiving unit is connected to the signal generator; the key signal input unit includes a switch, which is connected to the signal generator; the signal generator receives an input signal from the infrared signal receiving unit or the switch.

In some embodiments, the light strip control unit includes a signal receiving unit and an LED driving unit connected in series; the signal receiving unit is connected to the positive wire of the connecting portion, and is connected to the LED driving unit; the LED driving unit is also connected to a plurality of the LED beads; the signal receiving unit receives the driving signal output by the signal generator through the positive wire of the connecting portion, and outputs the signal to the LED driving unit; the LED driving unit controls each LED bead to be constantly on according to the signal of the signal receiving unit, or controls the LED beads of the flame bottom area and the outer flame area on the light strip to be on and off at a set frequency respectively, and controls the LED beads in the flame core area to be on and off in sequence.

BRIEF DESCRIPTION OF THE DRAWINGS

Some of the embodiments will be described in detail, with reference to the following figures, wherein like designations denote like members, wherein.

DETAILED DESCRIPTION

For a better understanding and implementation, embodiments of the present invention will be described in detail below in combination with accompanying drawings It should be understood that the technical features involved in the various embodiments described below may be combined with each other as long as there is no conflict with each other.

Figure 1:
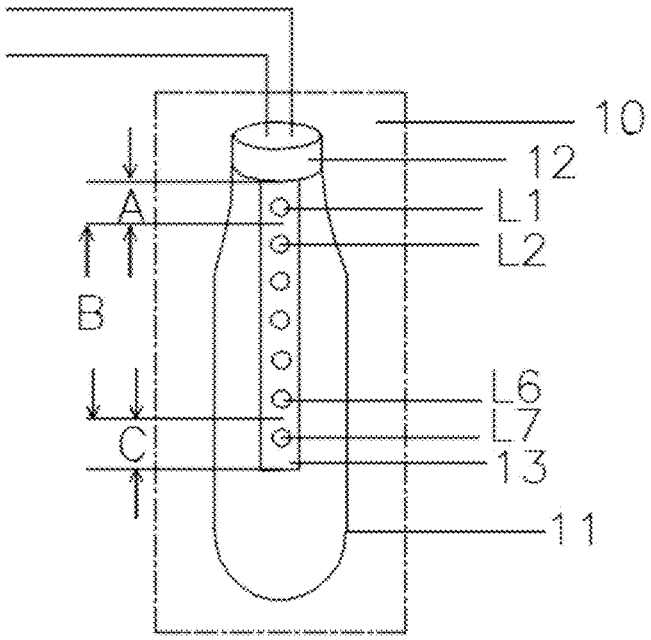
FIG. 1 is a structural sketch view of a LED flame bulb in some embodiments.

Referring to FIG. 1, the LED flame bulb of the present embodiment includes a bulb shell 11, a base 12, an LED light strip 13, and a light strip control unit. The base 12 is covered on the open end of the bulb shell, the LED light strip 13 is arranged in the bulb shell 11 with one end hung on the base 12. The light strip control unit is arranged on the base 12 and electrically connected to the light strip 13.

In some embodiments, the bulb shell 11 is a cylindrical, gallbladder, multi-prism, multi-prism crystal, sphere, ellipsoid, water drop body, flame body and other shapes with an open end. The base 12 can refer to relevant standards to choose a G-type or E-type screw holder. The G-type screw holder is a bulb holder that is connected to the positive and negative poles of the power supply with a double pin or a plug. The E-type screw holder is a bulb holder with screw thread arranged in the side wall of the cylinder and a bottom contact insulated from the screw thread arranged at the bottom, which are used to connect to the positive and negative poles of the power supply.

The LED light strip 13 includes a substrate and a plurality of LED beads disposed on the substrate. In order to simulate a flame, the substrate is divided into a flame bottom area A, a flame core area B, and an outer flame area C in sequence from the end of the substrate connected to the base to the other end. The LED beads in each area flash in accordance with preset flashing methods. The LED beads in the flame bottom area A and the outer flame area C are switched on and off according to the set frequency respectively. In some embodiments, methods to switch on and off of the LED beads in the flame bottom area A and the outer flame area C are synchronized. In some embodiments, at least two LED beads are arranged in the flame core area B, and the LED beads of area B in the linear direction from the flame bottom area A to the flame area C are switched on and off in sequence, wherein there is only one LED bead lit at the same moment.

In some embodiments, in order to mimic the variation of the beating flame brightness, the flame bottom area A, the flame core area B and the outer flame area C are with different brightness respectively, wherein the flame core area B has the highest brightness. This effect is achieved by setting the LED beads in different areas to have different power, or by controlling the light strip control unit to supply different current to the LED beads in different areas. The bulb differentiates the brightness of different areas to imitate different flame brightness of different parts.

In some embodiments, the substrate is a PCB board, and a total of 7 LED beads L1~L7 are linearly arranged on the substrate at equal intervals. The flame bottom area includes LED bead L1, the flame core area includes LED beads L2-L6, and the outer flame area includes LED bead L7, and the rated power ratio of the LED beads set in the flame bottom area, the flame core area and the outer flame area is 1:(3~5):(2~3), in order to simulate different brightness of different flame areas.

Figure 2:
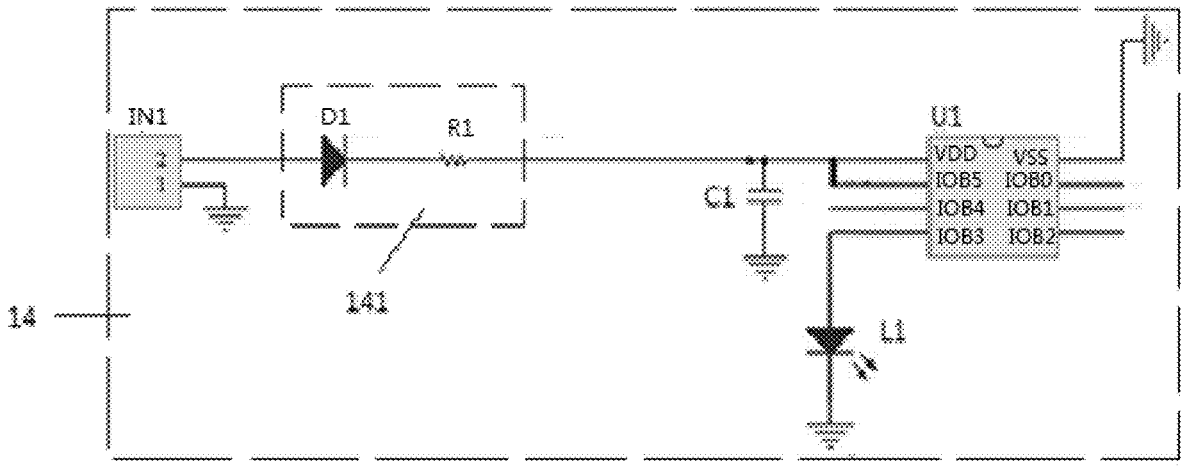
FIG. 2 is a circuit diagram of the light strip control unit.

Referring to FIG. 2, the light strip control unit 14 includes a voltage level output module IN1, a voltage regulating unit 141 and an LED driving unit, all of which are electrically connected in sequence. A stable voltage level is provided to the LED driving unit from the voltage level output module IN1 after being stabilized by the voltage regulating unit 141. The input terminal of the voltage level output module IN1 is connected to the positive pole of the base, the output terminal pin 1 of the voltage level output module IN1 is grounded, and its output terminal pin 2 outputs a voltage level signal; the voltage regulating unit 141 includes a diode D1 and a resistor R1 connected in series.

The LED driving unit is a chip U1. In some embodiments, the chip U1 includes a VDD pin to receive DC power supply, a grounded VSS pin, and six pins of IOB0-IOB5 to input or output signals. The VDD pin of the chip U1 is grounded through a capacitor C1 to filter clutter signals. The IOB4 pin and the IOB5 pin of the chip U1 are used to receive signals for mode selection, the IOB5 pin is connected to pin 2 of the output terminal of the voltage level output module IN1, and when it receives the signal, the chip U1 drives the LED beads to flash to simulate the flame. The IOB4 pin can be connected to an external circuit, where other mode of driving LED bead flashing can be set in the chip U1. When the IOB4 pin receives an input signal, the chip U1 can light up LED beads in other preset mode.

Figure 3:
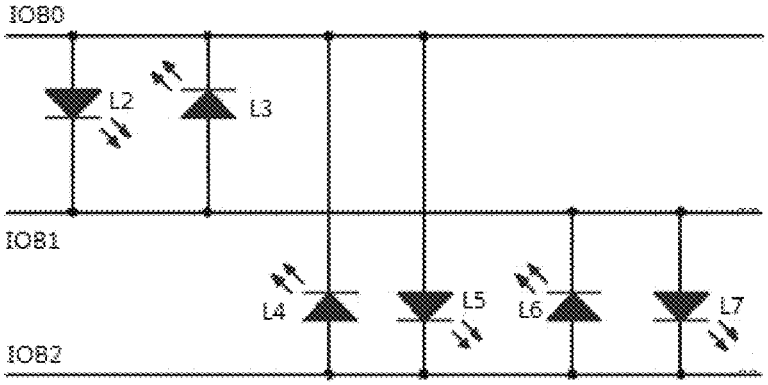
FIG. 3 is a circuit diagram of each LED bead connected to the light strip control unit in FIG. 3.

Please also referring to FIG. 3, LED bead L2 and L3 are connected in an anti-parallel method and then connected in series between the IOB0 pin and the IOB1 pin of the chip U1. LED bead L4 and L5 are connected in an anti-parallel method and then connected in series between the IOB0 pin and the IOB2 pin of the chip U1. LED bead L6 and L7 are connected in anti-parallel method and then connected in series between the IOB1 pin and the IOB2 pin of the chip U1. The IOB3 pin of the chip U1 is connected to LED bead L1 in series and then grounded. The chip U1 controls on and off of each LED bead through the square wave signal output from the pins of IOB0-IOB3. This connecting method can reduce output ends of the light strip control unit accordingly and improve the utilization rate of the output ends of the light strip control unit.

The chip U1 controls flashing modes of LED beads L1-L7 according to the preset control program. In some embodiments, the chip U1 controls the first bead L1 and the end LED bead L7 in the linear LED beads on and off synchronously, and the middle LED beads L2-L6 on and off in sequence, to emulate flame flickering. When LED beads L2-L6 are lit successively, only one LED bead is lit at the same moment.

In some embodiment, when supplying different current to the LED beads in different areas to realize varying effects of flickering flame brightness, a digital-to-analog conversion module DAC is also provided in the chip U1 to convert the square wave signal generated by the chip U1 into an analog signal, and output the analog current with varying amplitude through the pins of IOB0-IOB3. When simulating flame flickering, the driving current amplitude of the flame bottom area A and the outer flame area C when lighting from the pins of IOB0-IOB3 is less than that of the LED beads in the flame core area B. By making the actual luminous power of the LED beads in the flame core area B greater than that of the LED beads in the other two areas, the brightness of the LED beads in each area is changed to simulate the different brightness of each part of a flame when flame flickering.

Figure 4:
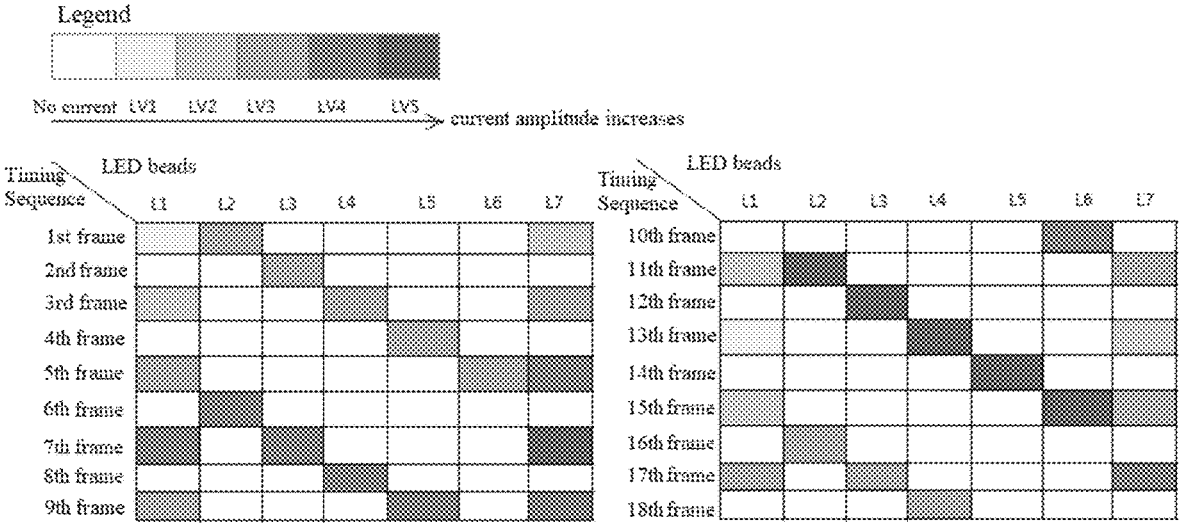
FIG. 4 is a timing sequence and brightness diagram of the LED beads flashing in FIG. 4.

In some embodiments, in the process of the chip U1 outputting a square wave to control the LED beads on and off to simulate flame, the amplitude of the current to the LED beads in the same area can also vary with time to emulate the changing effect when the flame beats with time. In some embodiments, each output current of the chip U1 is a sine wave. Referring to FIG. 4, the different shades of the squares in the figure indicate that the current amplitude received by the LED beads are in different amplitude ranges. In some embodiments, the flashing mode of LED bead L1 of the LED beads in the flame bottom area is lit once at intervals of one frame. In frames 1, 3, 5 and 7, the brightness of the LED bead L1 increases as the current amplitude increases when it is lit. In frames 9, 11, and 13, the brightness of the LED bead L1 decreases as the current amplitude decreases when it is lit. The flashing method of LED bead L7 in the outer flame area C is similar to that in the flame bottom area A, except that the lowest and highest current amplitude of the LED bead L7 are both higher than that in the flame bottom area A. The LED bead L2 in the flame core area B is lit in frame 1 with a current amplitude higher than that in the other two areas, and then LED bead L3-L6 is lit in turn in frames from 2 to 5 with a current of the same amplitude as that of LED bead L2 in frame 1 to complete a cycle. The cycle is repeated in frames 6 to 10 and then in frames 11 to 15, with the current amplitude in each cycle increased.

By adjusting the current in the above manner, the brightness change of the linearly arranged LED beads are shown by the higher brightness of the central area and the lower brightness of the two ends, which simulate flame brightness changing with time.

In some embodiment, a plurality of LED beads are arranged linearly on both sides of the substrate of the LED light strip, and the LED beads on the same position of both sides have the same flashing mode. In some embodiments, the number of LED beads on the light strip is variable as long as the proportion of the flame core area is greater than that of other areas, such as 1:2:1 or 2:3:2 or other, in order to simulate the different forms of flame bottom, flame core and the outer flame. The ratio of the actual luminous power of the LED beads in the flame bottom area A, flame core area B, and the outer flame area C can be 1:2:1 or 1:3:2 or other, to realize different brightness of different parts of the flame.

In some embodiments, multiple groups of LED beads may be arranged linearly along the direction of the light strip on the same surface of the substrate. Defining the direction from the flame bottom area to the outer flame area is radial and the direction perpendicular to the radial on the substrate is lateral, the LED beads simulate the flickering flame in a method that the LED beads in the lateral rows of the flame bottom area and the outer flame area keep flashing, and the LED beads in the lateral rows of the flame core area flash in sequence.

Compared with the prior art, the LED bulb in embodiments above can mimic flame effect of beating and flickering, and has the characteristics of small size, easy transport and carry, simple components, high integration and low cost, which has a wide application prospect. The substrate of the LED bulb is divided into the flame bottom area, the flame core area, and the outer flame area, and arranged with the LED beads in the flame bottom area and the outer flame area keeping flashed while LED beads in the flame core area lighting up in sequence to simulate flame flicker. Further, by setting different rated power of the LED beads or supplying different current to the LED beads in above different areas, a vivid effect of different brightness of flame bottom, flame core and the outer flame areas is achieved. Furthermore, in the embodiment of making the brightness of each area different by changing the supplying current, the current provided to each LED bead can also be changed with time, to realize the effect of flame brightness changing with time.

Figure 5:
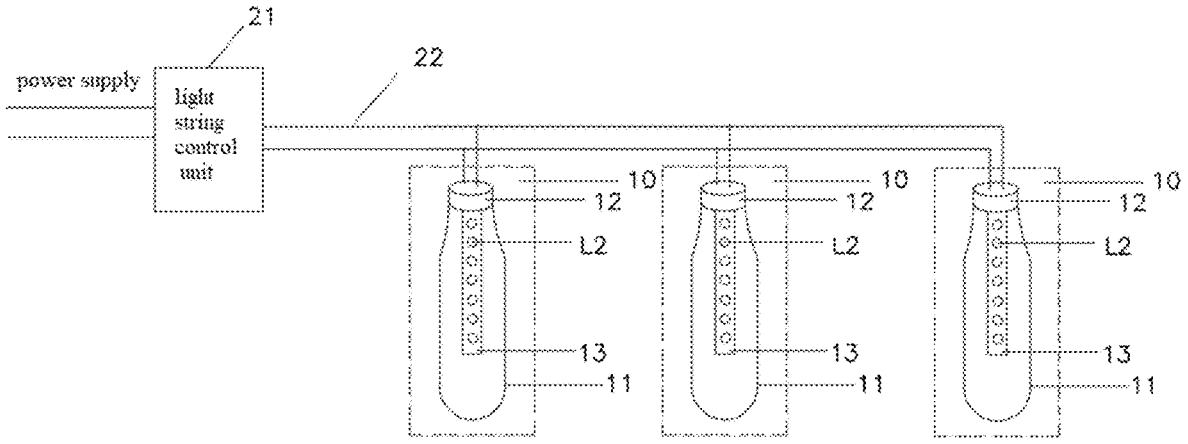
FIG. 5 is a structural sketch view of the LED flame bulb string of the present application.
Figure 6:
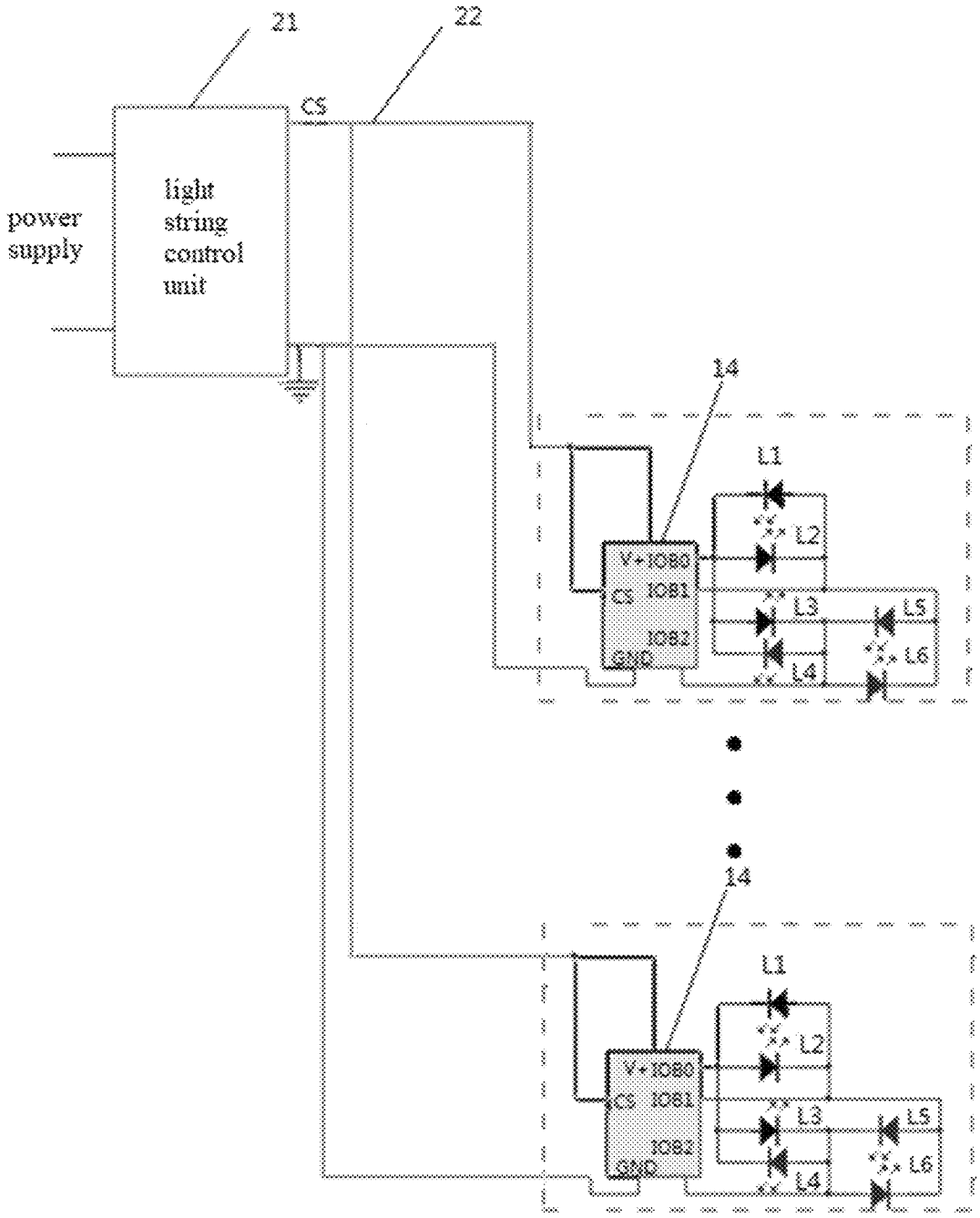
FIG. 6 is a sketch view of the connection between the light string control unit and the internal circuits of the LED bulbs in FIG. 6.

Referring to FIG. 5 and FIG. 6, in some embodiments, a light string includes a light string control unit 21, a connecting portion 22, and a plurality of LED flame bulbs 10. The plurality of LED flame bulbs are connected in parallel to the connecting portion 22, and the light string control unit 21 receives driving signal and controls each LED flame bulb 10 on and off through the connecting portion 22.

The connecting portion 22 includes a positive wire and a negative wire, one end of the positive wire is connected to the output end of the light string control unit 21 and the positive wire is also connected to the positive pole of the base of each LED flame bulb. One end of the negative wire is connected to the negative pole of the DC power and the negative wire is also connected to the negative pole of the base of each LED flame bulb.

Figure 7:
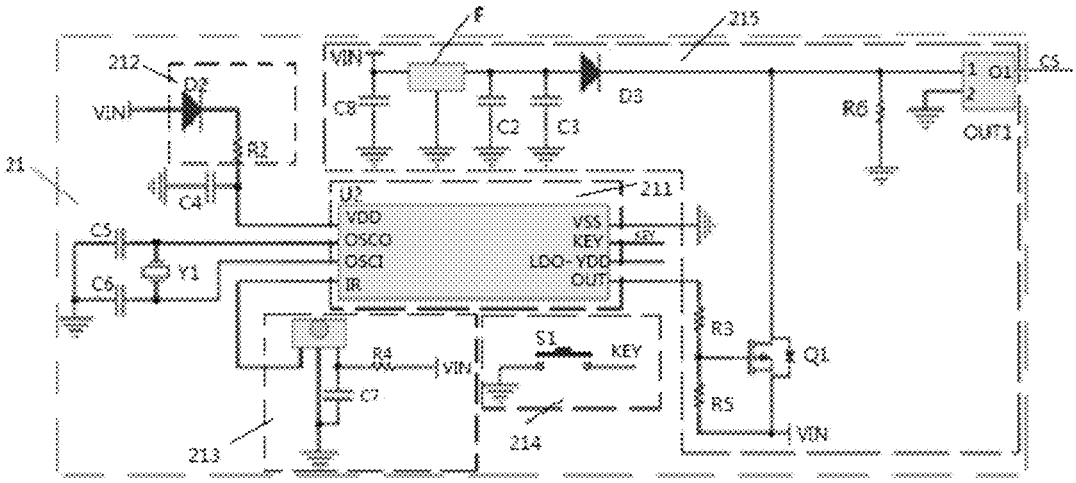
FIG. 7 is a circuit diagram of the light string control unit of the light string in FIG. 6.

Referring to FIG. 7, the light string control unit 21 includes a signal generator 211, a power conversion unit 212, an oscillator Y1, an infrared signal receiving unit 213, a key signal input unit 214, and a driving signal conversion unit 215.

In some embodiments, the signal generator 211 is a chip U2, which includes a VDD pin for receiving driving power, a VSS pin for grounding, an OSCI pin for receiving oscillator input, an OSCO pin for receiving oscillator output, an IR pin for receiving the infrared control signal output from the infrared signal receiving unit, a KEY pin for receiving the KEY control output from the key signal input unit, and an OUT pin for outputting the signal. The VDD pin of the chip U2 is grounded through the capacitor C4, the OSCI pin is grounded through the capacitor C5, and the OSCO pin is grounded through the capacitor C6, which are used to filter out clutter signals. A variety of programs are preset in the chip U2 to control the lighting mode of each LED bulb, which can control the LED bulbs to work in constant lighting mode at the same time or in sequence, or work in flame flicker emulation mode at the same time or in sequence.

In some embodiments, the power conversion unit 212 includes a diode D2 and a resistor R2 connected in series, wherein the positive terminal of the diode D2 is connected to the DC power, and the negative terminal of the diode D2 is connected to the VDD pin of the chip U2 through the resistor R2.

The infrared signal receiving unit 213 includes an infrared signal receiving unit, a resistor R4 and a capacitor C7. The infrared signal receiving unit includes three pins, the first pin of the infrared signal receiving unit is connected to the DC power through a resistor R4, and is also connected to the ground wire of the second pin through a capacitor C7 at the same time; the second pin of the infrared signal receiving unit is grounded; and the third pin of the infrared signal receiving unit is connected to the IR pin of the chip U2.

The key signal input unit 214 includes a switch Si, of which one end is grounded and the other end is connected to the KEY pin of the chip U2.

The light string control unit may receive the control signal input by the user from the infrared remote control or the switch, and then control the lighting mode of each LED bulb on the light string.

The driving signal conversion unit 215 includes a MOS transistor Q1, a resistor R3, a resistor R5 and a resistor R6, a capacitor C2, a capacitor C3 and a capacitor C8, a diode D3, a 3 V voltage conversion module F, and a signal output module OUT1. The voltage from the DC power VIN is stabilized at 3V through the 3.0V voltage conversion module F, then the voltage from the DC power VIN is connected to the signal output module OUT1 through the diode D3. The DC power VIN is also grounded through the capacitor C8. One end of the capacitor C2 with high capacitance and one end of the capacitor C3 with low capacitance are connected between the 3.0V voltage conversion module F and the diode D3, and the other ends are grounded to filter the power signal. One end of the resistor R6 is connected between the diode D3 and the signal output module OUT1, and the other end is grounded.

The MOS transistor Q1 is a P-channel enhanced MOS transistor, its source is connected to the DC power VIN, its gate is connected to the DC power VIN through a resistor R5, which is also connected to pin 5 of the chip U2 through a resistor R3, and its drain is connected between the diode D3 and the signal output module OUT1.

The signal output module OUT1 includes two input pins and one output pin, wherein the input pin 1 is electrically connected to the diode D3, the input pin 2 is grounded, and the output pin is connected to the positive wire of the connecting portion 22.

During operation, the user may press the switch Si or use the infrared remote control to transmit a signal to the infrared receiving unit to input the control signal. The VDD pin of the chip U2 receives the driving voltage regulated by the power conversion unit and starts to work, and the oscillator Y1 outputs a 32768 Hz clock oscillation signal to start-up the chip U2.

Meanwhile, the chip U2 changes the flashing mode of the light string once according to the control signal input by the user each time, and the chip U2 outputs varying signal to control the drain of the PMOS (positive channel Metal Oxide Semiconductor) transistor disconnected or output negative current, forming a 32 BIT drive signal that carries the control information of all LED bulbs and is output by the output module OUT1. The driving signal is transmitted through the connecting portion to the light strip control unit of each LED flame bulb to realize its specific lighting mode. After the chip U2 outputs a 32-bit drive signal and before the next user input control signal, the light string control unit will output DC power to the light strip control unit of each LED bulb.

In some embodiments, when the user inputs an infrared signal to the infrared receiving unit or presses the key switch, which controls each LED bulb to work in constant lighting mode, the light string control unit will control each LED bulb on the light string to light up constantly at the same time. Depending on the user's input of infrared control signals or the user's presses of the switch, the light string control unit can control the lighting mode of each LED bulb of the light string to switch to constant lighting sequentially, flame flicker emulation simultaneously or flame flicker emulation sequentially.

When the LED bulb is connected to the light string, the circuit structure of the light strip control unit of the LED bulb shall be adjusted in order to cooperate with the control unit of the light string.

Figure 8:
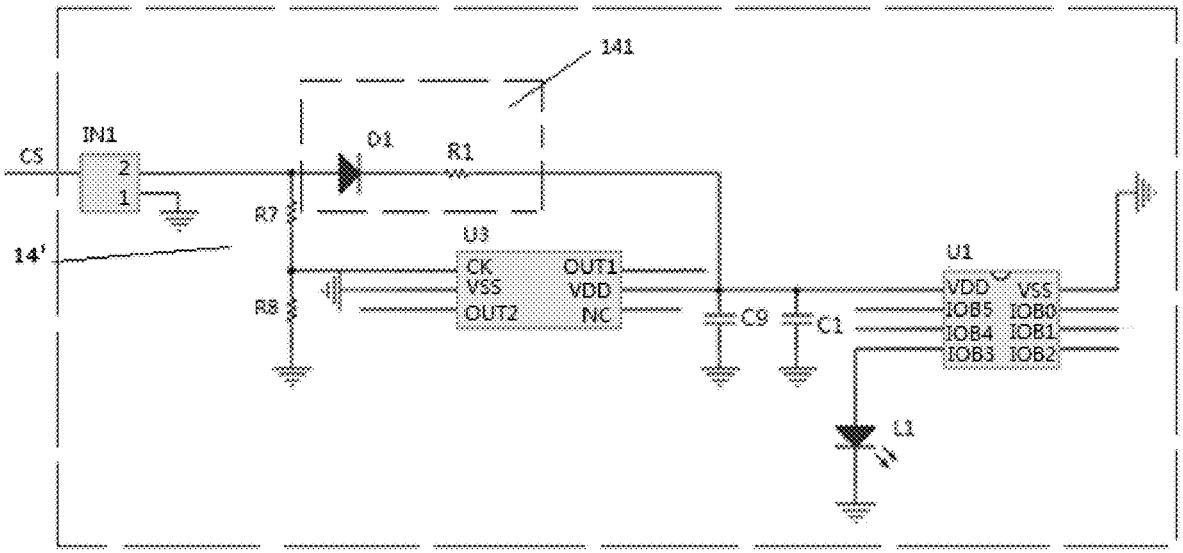
FIG. 8 is a circuit diagram of the light strip control unit of each LED bulb of the light string.

Please refer to FIG. 8, which is a circuit diagram of the light strip control unit 14' applied to the LED bulb in the light string. In this embodiment, in the light strip control unit 14' of the LED bulb, the structure of the current conversion unit and the LED driving unit is consistent with the structure of the above embodiments. The difference is that a signal receiving unit is also connected between the positive pole of diode D1 in the current conversion unit and the VDD pin of the LED driving unit. The signal receiving unit is a chip U3, which is used to receive the signal of the light string control unit.

In some embodiments, the chip U3 includes a VDD pin for receiving DC power supply, a CK pin for receiving a clock signal, a VSS pin for grounding, and pins of OUT1 and OUT2 for outputting signals. Wherein, the CK pin of the chip U3 is connected to the output pin 2 of the drive voltage level output module IN1 through the pull-up resistor R7, and is also grounded through the resistor R8 to achieve voltage clamping; the OUT1 pin of the chip U3 is connected to the IOB5 pin of the chip U1; the OUT2 pin of the chip U3 is connected to the IOB4 pin of the chip U1; the VDD pin of the chip U3 is also grounded through capacitor C9 to filter clutter signals.

In some embodiments, the chip U1 is preset with two LED bead driving modes of constant lighting and flame flicker emulation, of which the constant lighting mode is triggered when the IOB4 pin of chip U1 receives a signal, and the flame flicker emulation mode is triggered when the IOB5 pin of chip U1 receives a signal.

Figure 9:
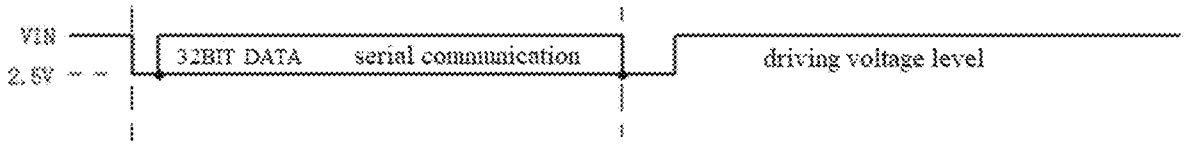
FIG. 9 is a waveform diagram of the output driving signal of the light string control unit.

When the light strip control unit 14' works, referring to FIG. 9, each time the user inputs a control signal, the light string control unit will output a driving signal, and the driving signal is received by the CK pin of the chip U3 of the signal receiving unit of each LED bulb. When the CK pin of the chip U3 receives the falling edge of the square wave of the driving signal, the chip U3 begins to read the 32 bit data input after the falling edge of the square wave, so as to confirm whether the LED bulb works, and whether the working mode is constant lighting mode or flame flicker emulation mode. During data transmission, the chip U3 controls the IOB0-IOB3 pins of the chips U1 not to output the voltage level by output signals from pins OUT1 and OUT2 of the chip U3, therefore the LED beads are not lit. Thus, the data transmission process is separated from the LED beads driving process to different time to avoid signal interference. When the chip U3 receives the falling edge of the square wave of the driving signal again, the chip U3 stops reading the square wave signal, but outputs the control signal to the chip U1 depending on the previously read signal to control its working mode. Meanwhile, the chip U1 receives the driving voltage level to start driving the LED bead. The chip U1 keeps driving the LED beads until the chip U3 detects the next falling edge signal of the square wave and repeats above process of reading the driving signal.

When the CK pin of the chip U3 receives the driving signal that drives the LED bulb to illuminate constantly, the OUT2 pin of the chip U3 outputs a signal to the IOB4 pin of the chip U1, and the chip U1 works in the constant lighting mode. The IOB0-IOB3 pins of the chip U1 output multiple driving voltage levels to light up each LED bead constantly. When the chip U3 receives the driving signal that drives the LED bulb to simulate flame flicker, the OUT1 pin of the chip U3 outputs the signal to the IOB5 pin of the chip U1, and the chip U1 works in flame flicker emulation mode. The IOB0-IOB3 pins of the chip U1 output signals according to a preset program, so that the LED beads in the flame bottom area and the outer flame area on the light strip keep flashing, and the LED beads in the flame core area light up in sequence to simulate flame flickering.

The LED light string provided by the present application has a variety of lighting modes including constant lighting, sequential flashing, synchronous flame flickering and sequential flame flickering, which can be realized by infrared remote control or switch control, simple to operate and rich in modes. The light string control unit u controls a plurality of LED bulbs in parallel through the positive wire and the negative wire, which can control the on/off operation of each LED bulb separately. Compared with the prior art where a multi-wire connection structure is required for the control unit and each LED bulb, only the positive wire and negative wire are needed due to the simplified connection between the light string control unit and each LED bulb.

In some embodiments, when the input power supply is AC power less than or equal to 230V, the power conversion unit includes a rectifier circuit and a voltage regulator circuit connected in sequence.

Although the present invention has been disclosed in the form of preferred embodiments and variations thereon, it will be understood that numerous additional modifications and variations could be made thereto without departing from the scope of the invention.

The invention claimed is:

1. An LED flame bulb string comprising a plurality of LED flame bulbs that are connected in parallel, a light string control unit and a connecting portion; wherein:

each LED flame bulb comprises an LED light strip and a light strip control unit;

the light strip comprises a substrate and a plurality of LED beads;

the substrate is divided into a flame bottom area, a flame core area and an outer flame area in order from one end to the other end, the plurality of LED beads are respectively arranged in the flame bottom area, the flame core area and the outer flame area;

at least 2 LED beads are in the flame core area;

the light strip control unit controls the LED beads in the flame bottom area and the outer flame area to be on and off at a set frequency respectively; and the light strip control unit controls the LED beads in the flame core area to be on and off in sequence;

the connecting portion comprises a positive wire and a negative wire; the plurality of LED flame bulbs are connected in parallel, of which the positive poles are connected to the light string control unit through the positive wire, and the negative poles are connected to the light string control unit through the negative wire;

the brightness of the LED beads in the flame core area is higher than that of the LED beads in the flame bottom area and the outer flame area;

a method for supplying power to different areas on the substrate is selected from a group consisting of method A and method B; wherein in method A, the rated power of the LED beads in the flame core area is greater than that of the LED beads in the flame bottom area and the outer flame area; wherein in method B, the current provided by the light strip control unit to the LED beads in the flame core area is greater than the current provided by it to the LED beads in the flame bottom area and the outer flame area;

the light strip control unit controls the current supplied to the LED beads in the flame bottom area, the flame core area and the outer flame area to vary with time;

the light string control unit comprises a signal generator and a driving signal conversion unit; the driving signal conversion unit comprises a diode, a PMOS transistor, a first resistor and a second resistor; the positive pole of the diode is connected to a DC power, and the negative pole of the diode is connected to the drain pole of the PMOS transistor through a first branch, and the negative pole of the diode is also connected to the positive wire of the connection portion through a second branch; the gate of the PMOS transistor is connected to the output end of the signal generator through a first resistor, and is connected to a DC power through a second resistor, and the source pole of the PMOS transistor is also connected to the DC power source; the signal generator outputs a driving signal to the positive wire of the connecting portion through the PMOS transistor of the driving signal conversion unit, and then controls the LED bulbs on the light string to light up in a method which is selected from a group consisting of constant lighting simultaneously, constant lighting sequentially, lighting up in flame flicker emulation mode simultaneously, and lighting up in flame flicker emulation mode sequentially.

2. The LED flame bulb string of claim 1, wherein the light string control unit comprises an infrared signal receiving unit; the infrared signal receiving unit comprises an infrared signal receiving unit, and the infrared signal receiving unit is connected to the signal generator; the signal indicating unit receives an input signal from the infrared signal receiving unit.

3. The LED flame bulb string of claim 1, wherein the light string control unit comprises a key signal input unit; the key signal input unit comprises a switch, which is connected to the signal generator; the signal generator receives an input signal from the infrared signal receiving unit and the switch.

4. The LED flame bulb string of claim 1, wherein the light strip control unit comprises a signal receiving unit and an LED driving unit connected in series; the signal receiving unit is connected to the positive wire of the connecting portion, and is connected to the LED driving unit; the LED driving unit is connected to the LED beads; the signal receiving unit receives the driving signal output by the signal generator through the positive wire of the connecting portion, and outputs the signal to the LED driving unit; a method of the LED driving unit controlling each LED bead is selected from the group consisting of method A and method B; in method A, each LED bead is constantly on; in method B, the LED beads of the flame bottom area and the outer flame area on the light strip are on and off at a preset frequency, and the LED beads in the flame core area are on and off in sequence.

5. The LED flame bulb string of claim 1, wherein the ratio of the luminous power of the LED beads in the flame bottom area, the flame core area and the outer flame area is 1:X:Y, the value of X is ranging from 3 to 5, including 3 and 5, the value of Y is ranging from 2 to 3, including 2 and 3.

* * * * *